US006014156A

United States Patent [19]

Yamane

[11] Patent Number: 6,014,156

[45] Date of Patent: Jan. 11, 2000

[54] ELECTROPHOTOGRAPHIC PRINTER HAVING IMAGE WRITING TIMED TO PREVENT TONER CLUMPING

[75] Inventor: Tsutomu Yamane, Tokyo, Japan

[73] Assignee: Oki Data Corporation, Tokyo, Japan

[21] Appl. No.: 08/856,814

[22] Filed: May 15, 1997

[30] Foreign Application Priority Data

May 17, 1996 [JP] Japan ..... 8-122943

[51] Int. Cl.[7] ..... B41J 2/385

[52] U.S. Cl. ..... 347/133

[58] Field of Search ..... 347/133, 130, 347/140, 129, 141, 131; 399/4, 235, 127, 128

[56] References Cited

U.S. PATENT DOCUMENTS 5,003,353 3/1991 Nitta ..... 399/235

FOREIGN PATENT DOCUMENTS 61-286860 12/1986 Japan .
1-297270 11/1989 Japan .

*Primary Examiner*—John Barlow
*Assistant Examiner*—Raquel Yvette Gordon
*Attorney, Agent, or Firm*—Rabin & Champagne, P.C.

[57] ABSTRACT

An electrophotographic printer includes a photosensitive drum, charging roller, image writing device, developing roller, and controller. The controller controls the operations of the image writing device and the developing roller so that a difference in potential between the surface of the photosensitive drum and the developing roller is below a firing potential. The controller causes the image writing device to fully emit light for a first predetermined time period immediately before completion of a printing operation, and for a second predetermined time period immediately after the printing operation starts, thereby bringing the surface of the drum to a potential nearly zero volts. The photosensitive drum stops rotating after the first predetermined time period and the photosensitive drum starts rotating immediately before the first predetermined time period. The photosensitive drum does not necessarily stop at exactly the same angular position after each printing operation. Likewise, the rising time and falling time of the bias voltage $V_B$ vary to some extent. In order to accommodate such variations, the controller compares an elapsed time after a preceding print operation has completed with a predetermined reference value. Then, the developing roller receives a bias voltage for the following print operation, the bias voltage being the same polarity as the surface oft he photosensitive drum charged by the charging device if the elapsed time is shorter than the predetermined value.

11 Claims, 11 Drawing Sheets

ELECTROPHOTOGRAPHIC PRINTER HAVING IMAGE WRITING TIMED TO PREVENT TONER CLUMPING

BACKGROUND OF THE INVENTION

1. Field of the Invention

The present invention relates to an electrophotographic printer.

2. Description of Related Art

With an electrophotographic printer, a charging device supplies static charges to a photosensitive drum. An LED head illuminates the photosensitive drum to form an electrostatic latent image on the photosensitive drum. Then, the electrostatic latent image is developed into a toner image by a developer. The toner image is then transferred to a print medium such as paper by means of a transferring device.

FIG. 9 illustrates a general construction of a prior art electrophotographic printer.

The photosensitive drum 11 rotates in a direction shown by arrow A. When the photosensitive drum 11 rotates, the charging roller 12, developing roller 15, transfer roller 18, and cleaning roller 13 are rotated in directions shown by arrows B, C, D, and E, respectively.

FIG. 10 illustrates a sequence of voltages on the respective rollers 12 and 15 when the printer shown in FIG. 9 performs printing operation. The shaft 12*a* of the charging roller 12 receives a charging voltage $V_A$ from a power supply 20 and the shaft 15*a* of the developing roller 15 receives a bias voltage $V_B$ from a power supply 21. The sequence of the voltages applied to the shafts 12*a* and 15*a* will be described.

Referring to FIG. 10, the charging voltage $V_C$ is a voltage on a surface area of the photosensitive drum 11 in contact with the developing roller 15.

Upon a print command, the power supply 20 supplies a negative charging voltage $V_A=-V_0$ to the shaft 12*a*. At this time, the surface region H (FIG. 9) of the photosensitive drum 11 downstream of the charging roller 12 but upstream of the developing roller 15 has not been charged yet.

During the time period t from the application of the negative charging voltage $V_A=-V_0$ till the trailing end of the surface region H (FIG. 9) passes the developing roller 15, the power supply 21 supplies a positive bias voltage $V_B=+V_1$ to the shaft 15*a*. This positive bias voltage $+V_1$ prevents toner particles from adhering to the photosensitive drum 11. After the time period t, the surface area of the photosensitive drum 11 which is brought into contact with the developing roller 15 has been negatively charged by the charging roller 12. The power supply 21 supplies a negative bias voltage $V_B=-V_2$ to the shaft 15*a* so that the toner particles are deposited on the photosensitive drum 11.

When performing continuous printing operation, the photosensitive drum 11 is rotated continuously and the power supply 21 continues to supply the negative bias voltage $V_B$ to the shaft 15*a*.

However, if one printing cycle is followed by the next printing cycle with a relatively short time interval therebetween, the following printing operation starts before the potential $V_C$ of the surface area of the photosensitive drum 11 in contact with the developing roller 15 has been discharged to nearly zero volts (shown by dotted line in FIG. 10). On the other hand, the bias voltage $V_B$ is set to $+V_1$ upon a print command, so that the potential difference between the photosensitive drum 11 and the developing roller 15 increases to a value greater than a firing potential.

Therefore, discharge takes place across the photosensitive drum 11 and developing roller 15 with the result that toner particles are reversely charged and clump by Coulomb force. This reduces the amount of toner which adheres to the developing roller 15, resulting in a decrease in print density.

SUMMARY OF THE INVENTION

The present invention was made in view of the aforementioned drawbacks of the prior art electrophotographic printer.

An object of the invention is to provide an electrophotographic printer which prevents the toner from electrostatically clumping within the developing device and maintains the desired print density.

An electrophotographic printer includes a photosensitive drum, charging roller, image writing device, developing roller, and controller. The charging roller applies charges on the surface of the photosensitive drum. The image writing device emits light in accordance with print data to write an electrostatic latent image on the surface of the photosensitive drum charged by the charging roller. The electrostatic latent image is developed by a developing roller, which deposits a developer material or toner on the electrostatic latent image to convert the electrostatic latent image into a visible image. The controller controls the operations of the image writing device and the developing roller so that a difference in potential between the surface of the photosensitive drum and the developing roller is below a firing potential.

The controller causes the image writing device to fully emit light for a first predetermined time period immediately before completion of a printing operation, and for a second predetermined time period immediately after the printing operation starts.

The photosensitive drum stops rotating after the first predetermined time period and the photosensitive drum starts rotating immediately before the first predetermined time period.

The controller compares an elapsed time after a preceding print operation has completed with a predetermined reference value. The developing roller receives a bias voltage for the following print operation, the bias voltage being the same polarity as the surface of the photosensitive drum charged by the charging device if the elapsed time is shorter than the predetermined value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The invention will be described in detail with reference to the accompanying drawings.

First Embodiment

Figure 1:
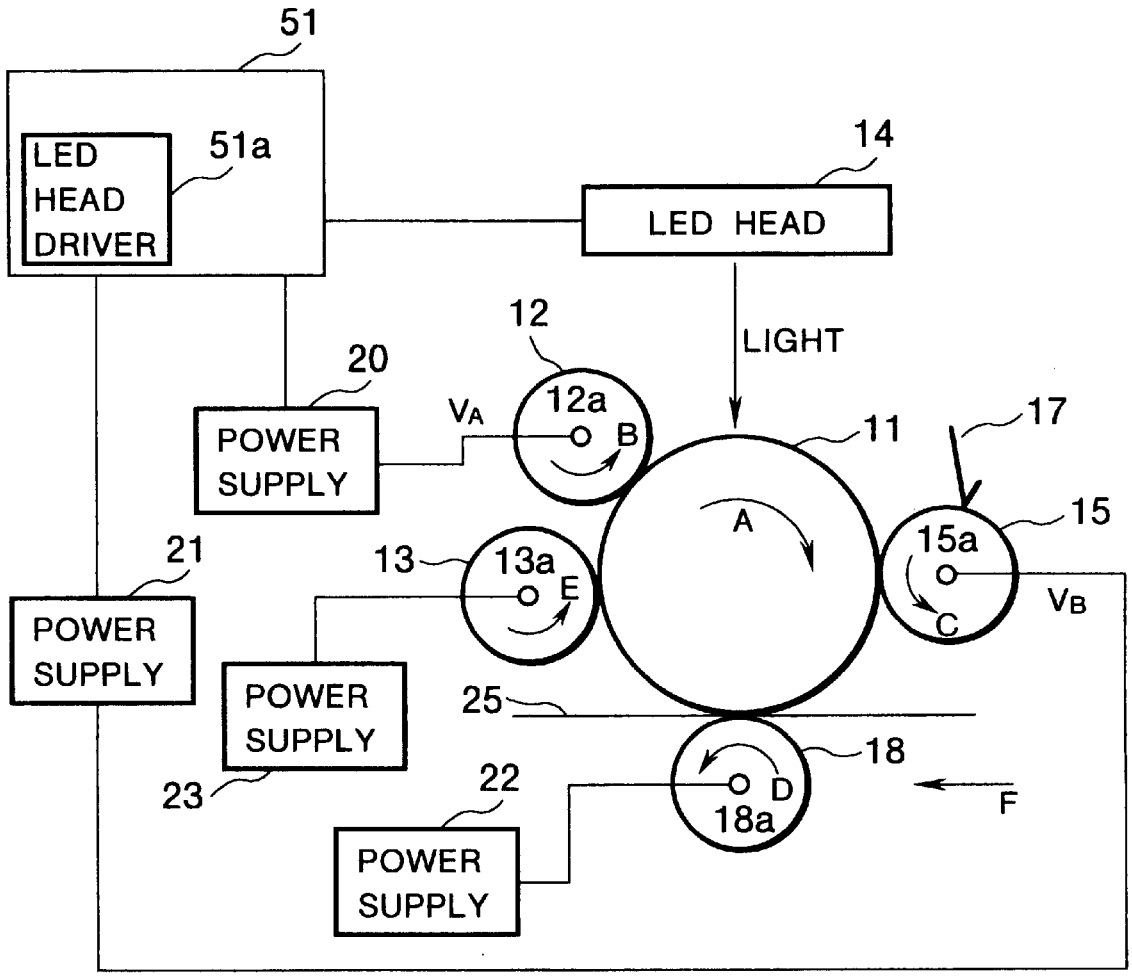
FIG. 1 illustrates a general construction of an electrophotographic printer according to an embodiment of the invention.

FIG. 1 illustrates a general construction of an electrophotographic printer according to an embodiment of the invention. Referring to FIG. 1, an electrophotographic printer is provided with a photosensitive drum 11 as an image bearing body. Disposed around the photosensitive drum 11 are a charging roller 12, latent image writing means 14, for example in the form of an LED head, developing roller 15, transfer roller 18, and cleaning roller 13. The charging roller 12 receives a high voltage $V_A$ from a power supply 20 and operates as a charging device for uniformly supplying static charges to the surface of the photosensitive drum 11. The LED head 14 illuminates the surface of the photosensitive drum 11 to form an electrostatic latent image on the photosensitive drum 11. The developing roller 15 receives a high voltage $V_B$ from a power supply 21 and operates as a developing device which supplies the electrostatic latent image with negatively charged developer material such as toner particles, not shown, to convert the electrostatic latent image into a toner image. The toner image is a visible image. The transfer roller 18 is urged against the photosensitive drum 11 with a predetermined amount of force. The transfer roller 18 receives a positive high voltage from a power supply 22 and transfers the toner image formed on the photosensitive drum 11 to the print paper 25. The cleaning roller 13 receives a positive high voltage from a power supply 23 and removes the charges on the photosensitive drum 11 and the residual toner left on the photosensitive drum 11 after the toner image has been transferred to the print paper 25. A controller 51 controls the entire operation of the electrophotographic printer. The controller 51 includes an LED head driver 51*a* which drives the LED head 14 to emit light in order to write an electrostatic latent image on the photosensitive drum 11.

The photosensitive drum 11, charging roll 12, developing roller 15, transfer roller 18, and cleaning roller 13 are rotated in directions shown by arrows A, B, C, D, and E, respectively.

The operation of the electrophotographic printer of the aforementioned construction will be described.

In the charging process, the power supply 20 supplies a negative voltage to a shaft 12*a* of the charging 12. Then, the surface of the photosensitive drum 11 in contact with the charging roller 12 is uniformly charged to a predetermined potential.

In the latent image write process, the surface of the photosensitive drum 11 is exposed to the light emitted from the LED head 14 so that an electrostatic latent image is formed on the surface. The potential of the exposed areas of the surface increases to a potential close to zero volts while non-exposed areas remain highly negatively charged.

In the developing process, the developing roller 15 urged to the photosensitive drum 11 rotates in the direction shown by arrow C. The shaft 15*a* of the developing roller 15 receives a negative bias voltage from the power supply 21. A thin layer of toner applied to the developing roller 15 by a toner applicator 17 is deposited to the photosensitive drum 11 as the developing roller 15 rotates, the electrostatic latent image being developed into a toner image.

In this case, the photosensitive drum 11 and the toner are charged to the same polarity and thus reversal development takes place.

In the subsequent transfer process, the transfer roller 18 is urged by a predetermined force against the photosensitive drum 11 and is rotated in the direction shown by arrow D. The power supply 22 applies a positive transfer voltage to the shaft 18*a*, the toner image on the photosensitive drum 11 being transferred to the print paper 25 which is transported by a transporting means, not shown, in a direction shown by arrow F.

The paper 25 leaves the photosensitive drum 11 after the toner image is transferred to the paper 25 and is fed to a fixing device, not shown, which fixes the toner image on the paper. The paper 25 is then discharged from the electrophotographic printer. Some of the toner remains on the photosensitive drum 11 after the transfer operation.

In the cleaning process, the cleaning roller 13 is in contact with the surface oft he photosensitive drum 11. A power supply 23 supplies a positive voltage to the shaft 13*a*, so that the remaining toner on the photosensitive drum 11 is deposited on the cleaning roller 13 from the photosensitive drum 11.

Performing the aforementioned processes in sequence completes a printing cycle. Repeating the processes allows printing of many pages of paper.

Figure 2:
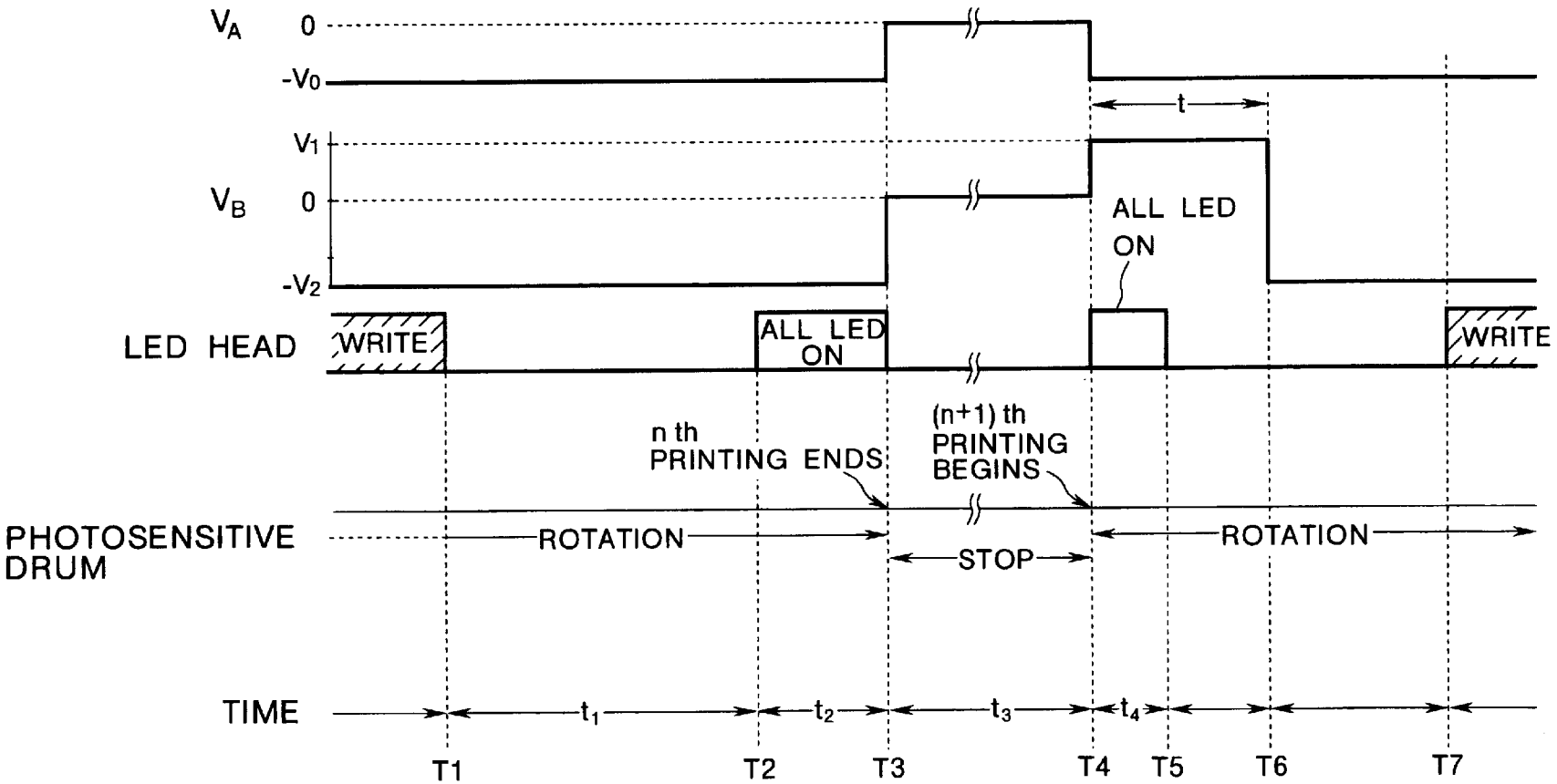
FIG. 2 illustrates sequence of the voltages from the end of the image-write cycle till the beginning of the next image-write cycle.

FIG. 2 illustrates the sequence of the voltages from the end of one image-write cycle till the beginning of the next image-write cycle. FIGS. 3A–3F illustrate the positional relations among the photosensitive drum 11, charging roller 12, and developing roller 15 at various timings.

The sequence of the charging voltage $V_A$ and bias voltage $V_B$ will be described with reference to FIGS. 2 and 3A–3F.

Figure 3A:
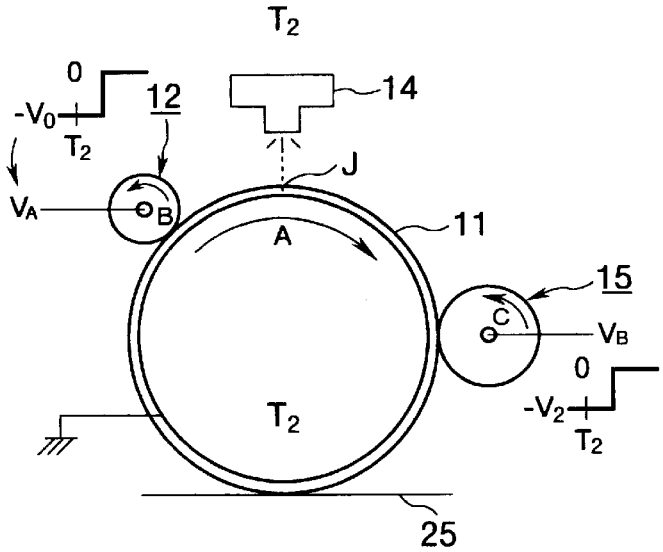
FIGS. 3A–3F illustrate the positional relations among the photosensitive drum 11, charging roller 12, and developing roller 15 at various timings.

Referring to FIGS. 2 and 3A, the shaft 12*a* of the charging roller 12 receives the charging voltage $V_A$ from the power supply 20 and the shaft 15*a* of the developing roller 15 receives the bias voltage $V_B$ from the power supply 21.

When the LED head 14 completes the image write cycle in the nth printing operation at timing T1, the photosensitive drum 11 is rotated at least one complete rotation in the direction of arrow A.

Figure 3B:
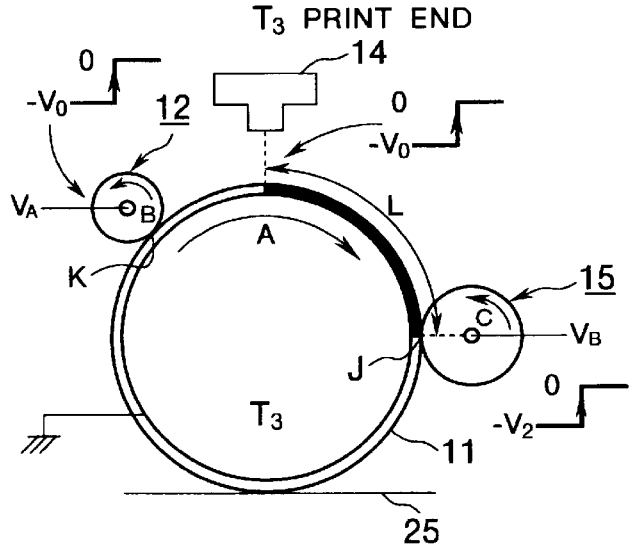
Figure 3C:
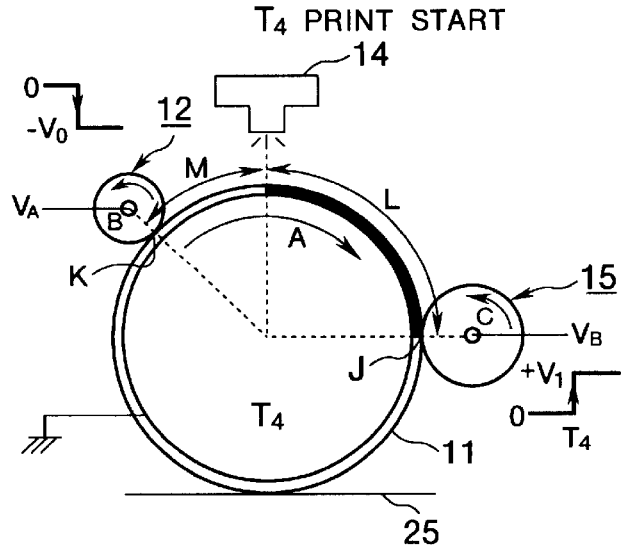

The LED head 14 begins to emit light onto a surface position J (FIG. 3A) of the photosensitive drum 11 at timing T2 upon a command outputted from the LED head driver 51*a* in the controller 51 shown in FIG. 1. Then, all the LEDs of the LED head 14 are driven to simultaneously emit light. The LED head 14 emits light from timing T2 till the surface position J of the photosensitive drum 11 opposing the LED head 14 at timing T2 is brought into contact with the developing roller 15 at time T3 (FIG. 3B). As a result, a first region L (FIG. 3B) of the photosensitive drum 11 is charged to a potential of nearly zero volts as the photosensitive drum 11 rotates till the surface position J arrives at the developing roller 15 at timing T3. The solid black area in FIG. 3B indicates the region L which has been exposed to the light. At timing T3, the drum 11 is stopped, completing the nth printing operation.

The photosensitive drum 11 is stationary for a time period t3, i.e., from timing T3 to timing T4, and the outputs of the power supplies 20 and 21 are zero volts for the time period t3. The length of time period t3 may vary depending on how frequently the printer is used. The (n+1)th printing operation begins at timing T4. At timing T4, the photosensitive drum 11 begins to rotate in response to a print command PC sent from a host apparatus and the power supplies 20 and 21 output a charging voltage of $V_A=-V_0$ and a bias voltage $V_B=+V_1$, respectively. All the LEDs of the LED head 14 also start emitting light at timing T4.

Figure 3D:
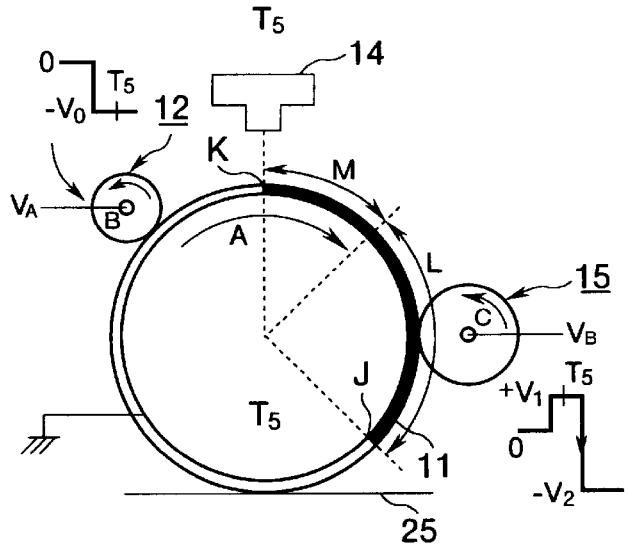

A surface position K on the photosensitive drum 11 is in contact with the charging roller 12 at timing T4. The LED head 14 continues to emit light for a second time period t4, i.e., from timing T4 to timing T5, during which the surface position K on the photosensitive drum 11 rotates to an angular position where the surface position K directly opposes the LED head 14 as shown in FIG. 3D. Thus, a second region M on the photosensitive drum 11 has discharged to a potential of nearly zero volts.

Figure 3E:
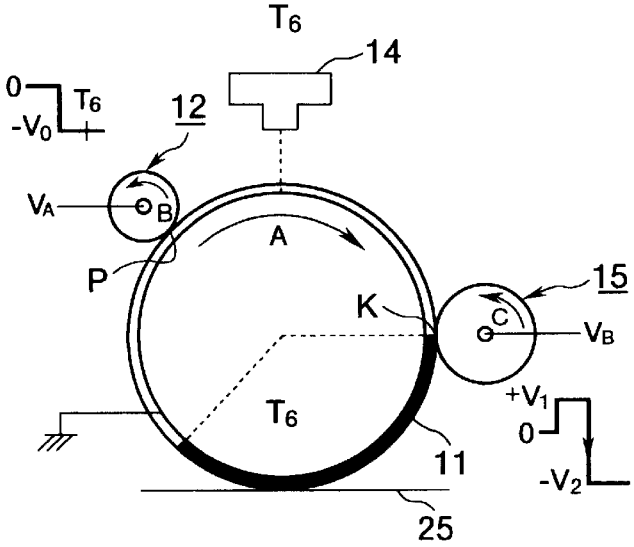
Figure 3F:
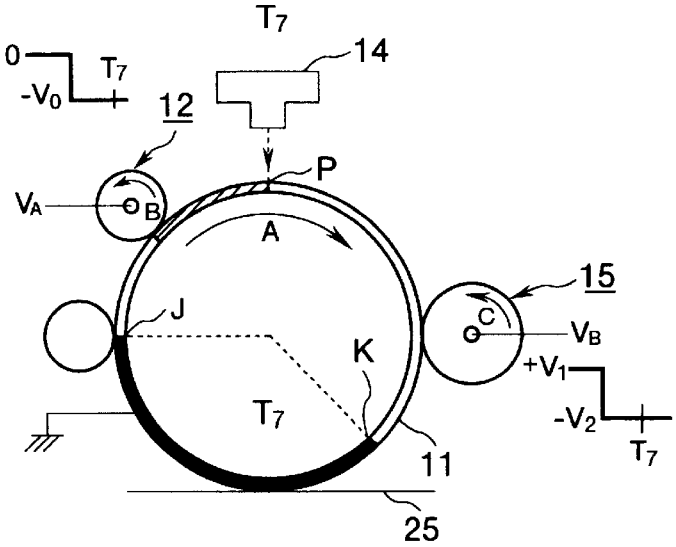

When the surface position K comes into contact with the developing roller 15 at timing T6, the bias voltage $V_B$ is switched from $+V_1$ to $-V_2$ (FIG. 3E). Then, the LED head 14 begins to write an image on the photosensitive drum 11 at timing T7 (FIG. 3F).

Figure 4:
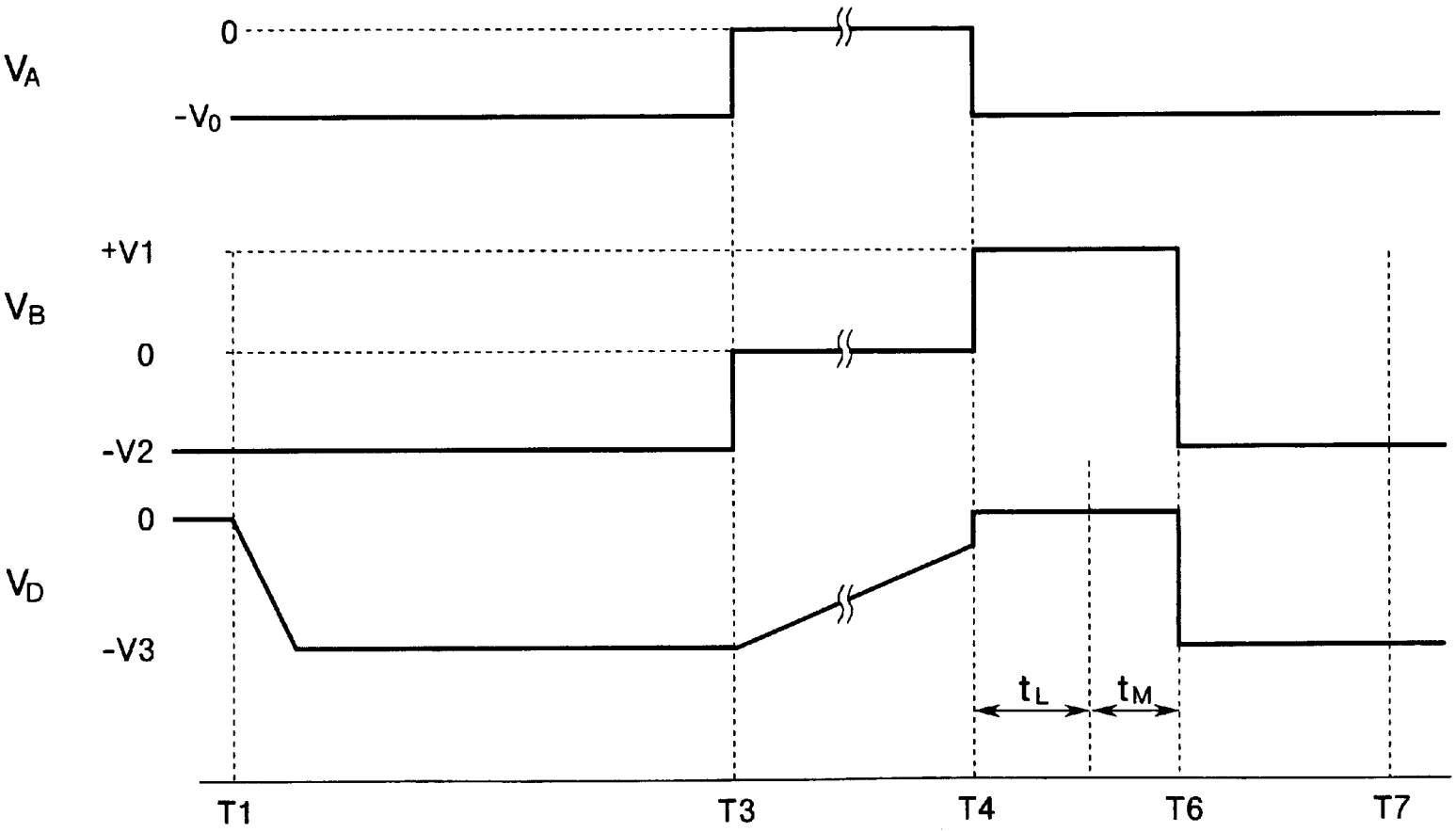
FIG. 4 is a timing chart illustrating the relation between the bias voltage $V_B$ and the surface voltage $V_D$ of the photosensitive drum 11.

FIG. 4 is a timing chart illustrating the relation between the bias voltage $V_B$ of the developing roller 15 and the surface voltage $V_D$ on the photosensitive drum 11 in contact with the developing roller 15.

The relation between the bias voltage $V_B$ and a potential $V_D$ will be described with reference to FIG. 4.

As previously described, the LED head 14 continues to write an image on the photosensitive drum 11 till timing T1. A surface area of the photosensitive drum 11 opposes the LED head 14 when the image-write cycle completes. The potential on this surface area is unstable till this surface area is brought into contact with the developing roller 15.

The photosensitive drum 11 is rotated by at least one complete rotation during the time period t1+t2 between timings T1 and T3, and is stopped at timing T3. From timing T1 to timing T3, the charging voltage $V_A$ is set to $-V_0$ and therefore the surface potential $V_D$ is $-V_3$. The bias voltage $V_B$ is $-V_2$.

The charging voltage $V_A$ is set to zero volts at timing T3, and therefore after timing T3, the surface potential $V_D$ gradually rises from $-V_3$ toward zero volts. The (N+1)th printing operation begins at timing T4 and the photosensitive drum 11 starts to rotate at timing T4.

Then, the bias voltage $V_B$ is set to $+V_1$ at timing T4. However, if the (N+1)th printing operation begins before the surface potential $V_D$ has discharged sufficiently close to zero volts, the potential difference between the photosensitive drum 11 and developing roller 15 becomes larger than a firing potential. Such a high potential difference causes discharge to take place between the photosensitive drum 11 and developing roller 15, causing the toner to be reversely charged. The LED head 14 continues to emit light during the time period t2 (i.e., T2 to T3) till the photosensitive drum 11 is stopped, so that the surface potential in the region L on the photosensitive drum 11 is discharged to nearly zero volts. Thus, the region L remains in contact with the developing roller 15 for a first time period $t_L$ after the photosensitive drum 11 begins to rotate at timing T4, so that the surface potential $V_D$ becomes sufficiently close to zero volts.

The LED head 14 emits light for a time period t4 (FIG. 2) after the photosensitive drum 11 begins to rotate at timing T4, so that the region M continuous with the region L is discharged to a surface potential of nearly zero volts. Thus, the region M is brought into contact with the developing roller 15 for a time period $t_M$ immediately after the time $t_L$, so that the surface potential $V_D$ becomes nearly zero volts.

Thus, the potential difference between the photosensitive drum 11 and the developing roller 15 can be lower than a firing potential. As a result, the reversely charged toner particles will not be produced, preventing the toner from electrostatically clumping within the developing device, not shown. Also, a sufficient amount of toner will be deposited to the developing roller 15 preventing print density from decreasing.

The LED head 14 needs to illuminate the regions L and M only for time periods t2 and t4, respectively, and need not illuminate the entire surface of the photosensitive drum 11, requiring a shorter time for printing operation.

Second Embodiment

In the first embodiment, the photosensitive drum does not necessarily stop at exactly the same angular position after each printing operation. Likewise, the rising time and falling time of the bias voltage $V_B$ vary to some extent. In order to accommodate such variations, the LED head 14 should illuminate the photosensitive drum 11 for time periods shorter than the time length during which the regions L and M oppose the LED head 14.

Illuminating over a region wider than the region L+M fails to ensure that the surface potential $V_D$ is nearly zero volts for a time period between immediately after timing T4 and immediately before timing T6, leaving some areas where discharge takes place between the photosensitive drum 11 and developing roller 15. The second embodiment eliminates such areas in which discharge takes place.

Figure 5:
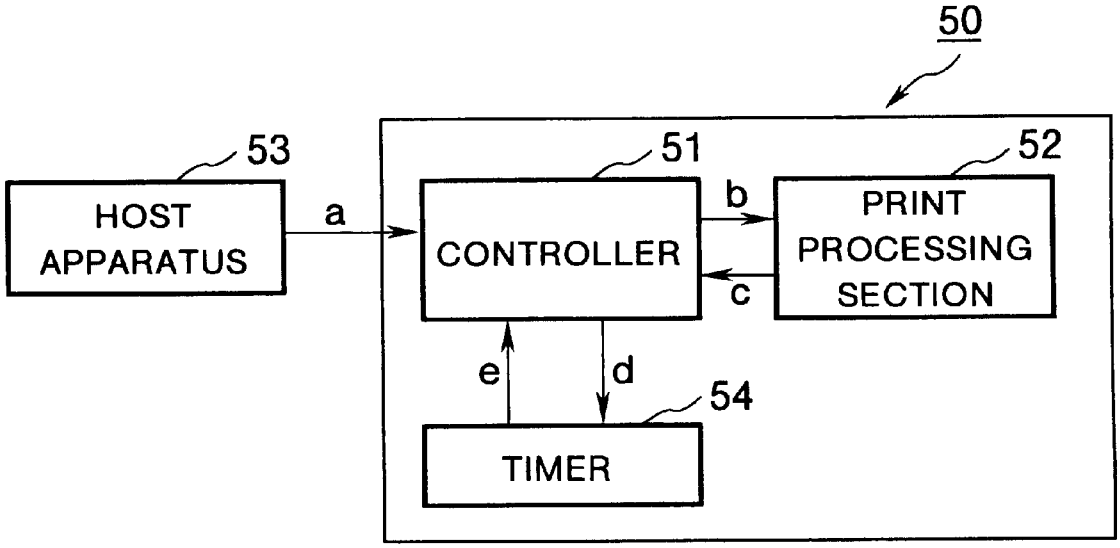
FIG. 5 is a block diagram of an electrophotographic printer according to the second embodiment.

FIG. 5 is a block diagram of an electrophotographic printer according to the second embodiment. Referring to FIG. 5, a controller 51 receives a print command and print data from a host apparatus 53 and controls the entire operation of the printer 50. The host apparatus 53 takes the form of, for example, a personal computer which transmits print data to the controller 51. Upon receiving the print data from the host apparatus 53, the controller 51 converts the print data into an image data. The controller 51 transfers the image data to the print processing section 52 which prints the image data. The controller 51 controls the timings at which the print data is communicated over a signal line a between the host apparatus 53 and the controller 51. The controller 51 communicates with the print processing section 52 via the signal lines b and c, and with a timer 54 via signal lines d and e.

Figure 6:
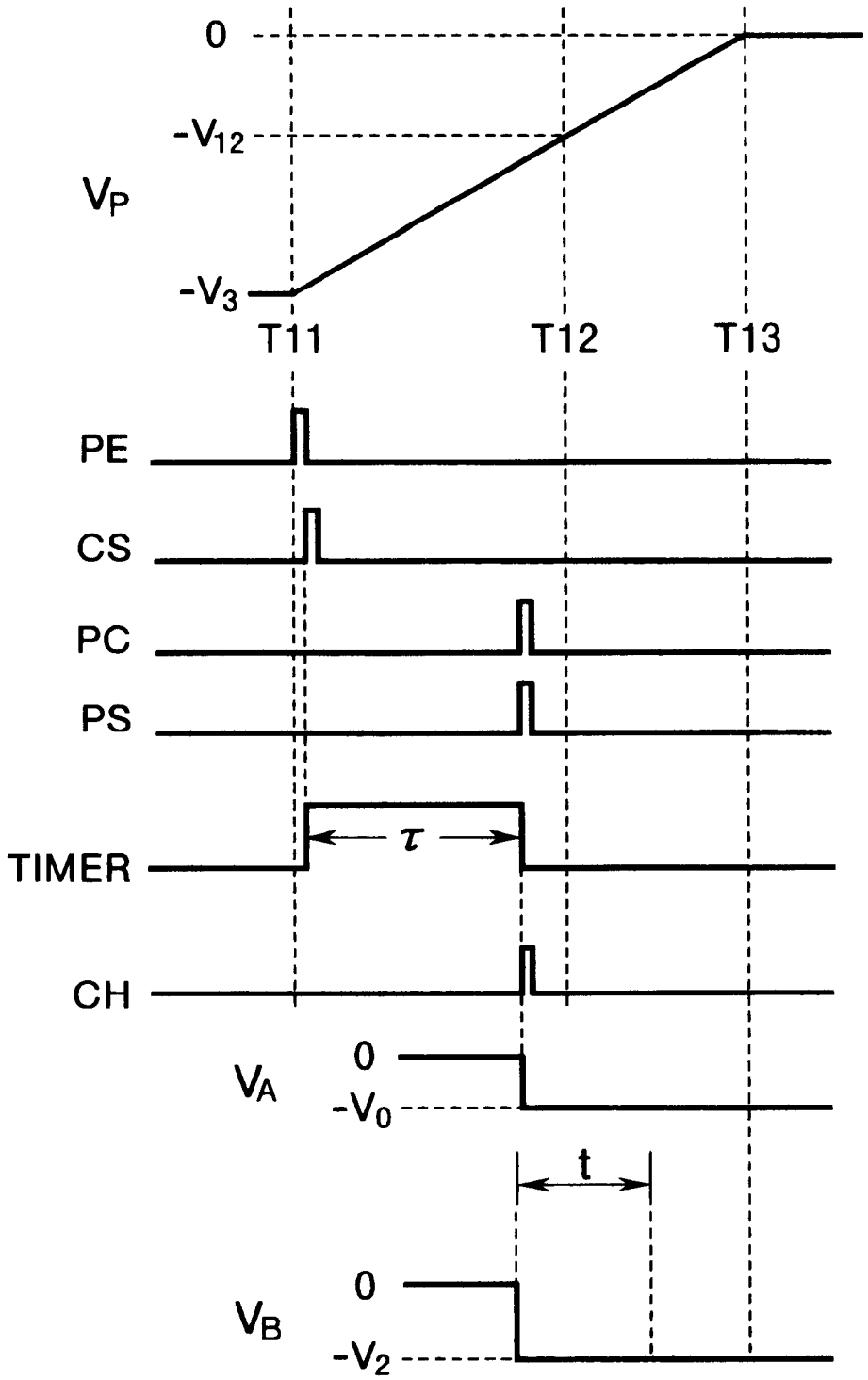
FIG. 6 illustrates a characteristic of the photosensitive drum of the second embodiment.

FIG. 6 illustrates a characteristic of the photosensitive drum 11 of the second embodiment.

As previously described, the power supply 20 supplies a voltage to the shaft 12*a* of the charging roller 12 so that the surface of the photosensitive drum 11 is charged to a potential $Vp=-V_3$. The power supply 20 stops the application of the voltage to the shaft 12*a* at timing T11, and the potential Vp varies with a time constant such that the potential Vp descreases to $-V_{12}$ at timing T12 and to 0 volts at timing T13.

When the bias voltage $V_B=+V_1$ is applied to the shaft 15*a*, discharge will occur between the photosensitive drum 11 and developing roller 15 if the $V_1$ and Vp are in the following relation.

$$|V_1|+|Vp|\geqq Vf$$

where Vf is a firing potential.

The $VP=-V_{12}$ is a voltage so that $|V_1|+|Vp|$ is just equal to Vf at timing T12. Thus, discharge occurs if $|Vp|\geqq|-V_{12}|$. In other words, discharge occurs if the bias voltage $V_B=|V_1|$ is applied to the developing roller 15 at or before timing T12.

The printing operation of the second embodiment will now be discussed.

Referring to FIGS. 5 and 6, when the controller 51 receives the print command PC and print data for the nth printing operation via signal line a from the host apparatus 53, the controller 51 outputs a print start command PS to the print processing section 52 over the signal line b. The controller 51 also converts the print data into image data and transfers the image data to the print processing section 52 over the signal line b.

The print processing section 52 performs printing operation in accordance with the image data and sends a print end signal PE to the controller 51 over the signal line c upon completion of the printing operation. Upon receiving the print end signal PE, the controller 51 sends a count start signal CS to the timer 54 over the signal line d. Then, the timer 54 resets the count therein in response to the count start signal CS and starts a new counting cycle.

When the controller 51 receives a print command PC and print data for the (n+1) th printing operation from the host apparatus via the signal line a, the controller 51 outputs a print start command PS and the image data to the print processing section 52.

The controller 51 also sends a count halt command CH to the timer 54 over the signal line d. In response to the count halt command CH, the time 54 stops counting and outputs its count τ to the controller 51 over the signal line e.

The controller 51 compares the count τ with the predetermined time length from T11 to T12. If τ≦(T12−T11) as shown in FIG. 6, then the surface potential Vp is expressed by $$|Vp|\geqq|Vp \text{ at } T12|=|-V_{12}|$$

and determines that discharge will occur between the photosensitive drum 11 and developing roller 15. Thus, the controller 51 sends a command to the print processing section 52 over the signal line b, the command requesting that a bias voltage $V_B$ is set to $-V_2$ instead of $+V_1$ during the time period t shown in FIGS. 3 and 6. In this case, the surface potential Vp is sufficiently negatively large so that the negative bias voltage $V_B$ will not cause the toner on the developing roller 15 to adhere to the photosensitive drum 11.

Figure 7:
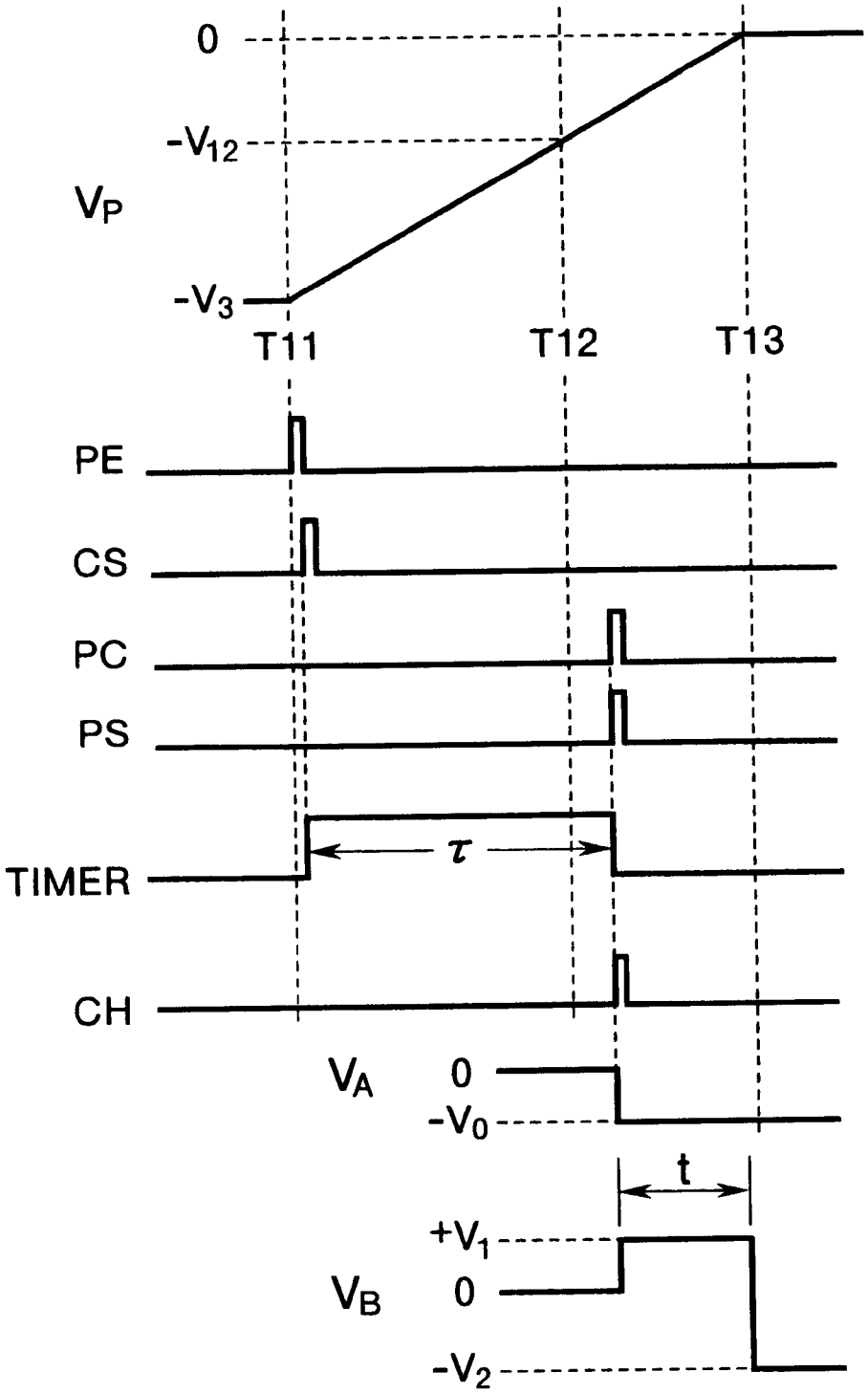
FIG. 7 illustrates a characteristic of the photosensitive drum of the second embodiment.

If τ≧(T12−T11) as shown in FIG. 7, then the surface potential Vp is expressed by $$|Vp|<|Vp \text{ at } T12|=|-V_{12}|$$

and the controller 51 determines that discharge will not occur between the photosensitive drum 11 and developing roller 15. The controller 51 then outputs a command to the print processing section 52 over the signal line b, the command requesting that the bias voltage $V_B$ is set to $+V_1$ during the time period t shown in FIGS. 3 and 7.

In this manner, the bias voltage $V_B$ is set to a voltage of the same polarity (negative) as the charged surface of the photosensitive drum 11 if the time τ is shorter than the predetermined time length T12−T11. Thus, discharge is prevented from occurring between the photosensitive drum 11 and developing roller 15.

Figure 8:
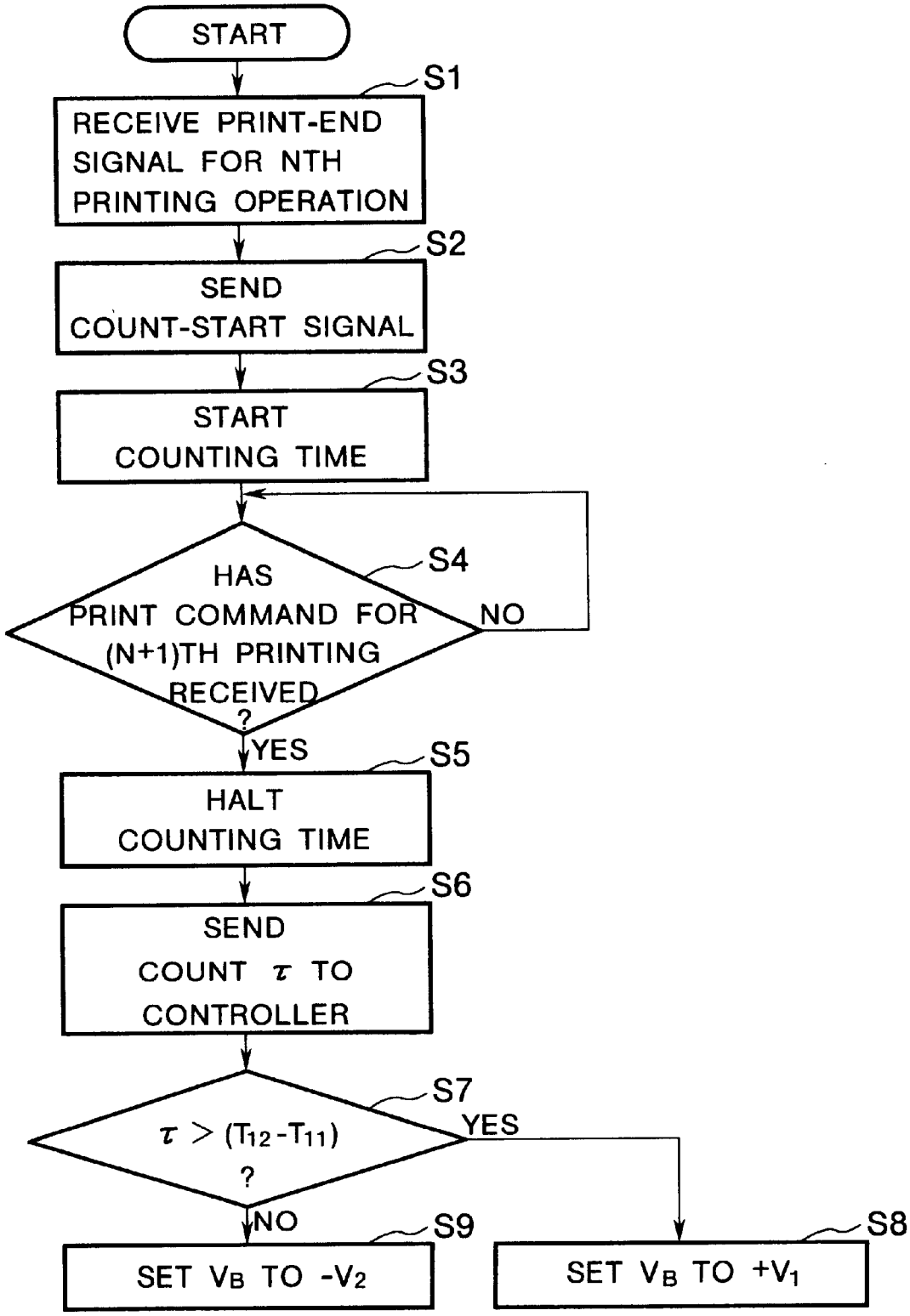
FIG. 8 is a flowchart illustrating the operation of the timer of the second embodiment.
Figure 9:
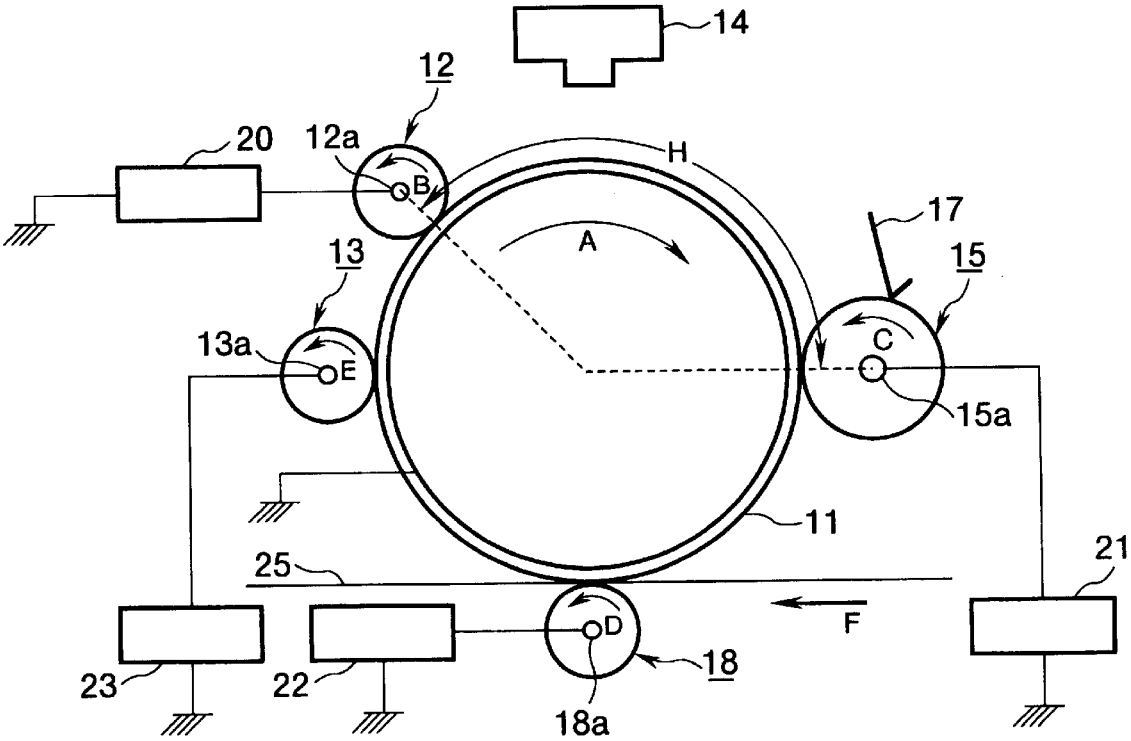
FIG.9 PRIOR ART
FIG. 9 illustrates a general construction of a prior art electrophotographic printer.
Figure 10:
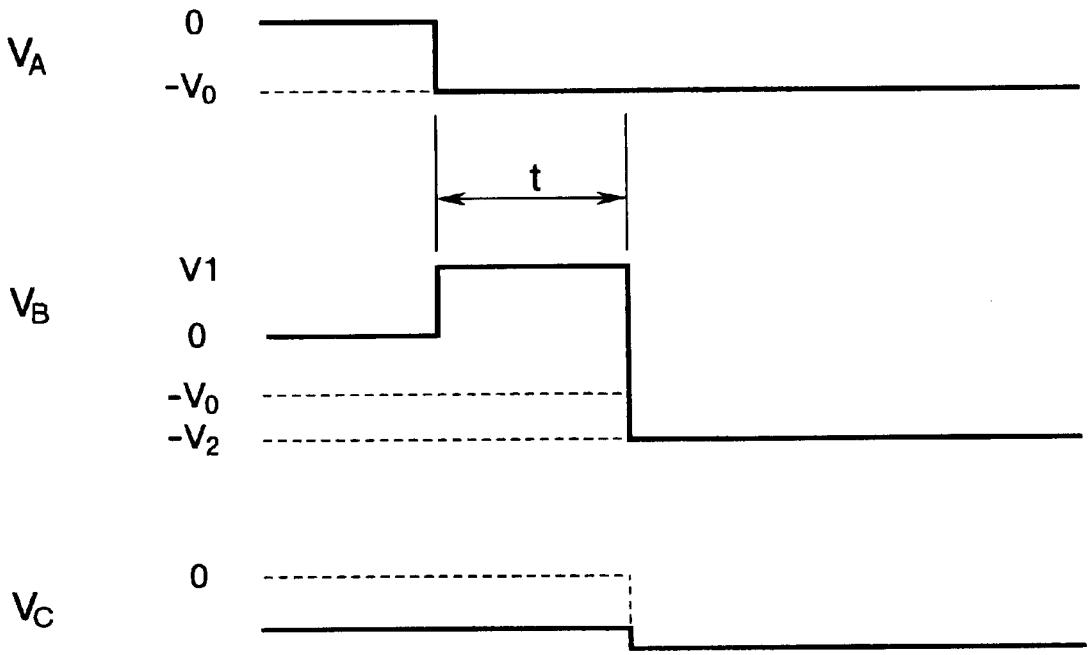
FIG.10 PRIOR ART
FIG. 10 illustrates a sequence of voltages on the respective rollers when the printer shown in FIG. 9 performs printing operation.

FIG. 8 is a flowchart illustrating the operation of the timer 54 of the second embodiment.

Step S1: The controller 51 receives a print end signal PE of the nth printing operation from the print processing section 52.

Step S2: The controller 51 sends a count start signal CS to the timer 54.

Step S3: The timer 54 starts counting time.

Step S4: The controller 51 waits for a print command PC for the (n+1)th printing operation which will be outputted from the host apparatus 53.

Step S5: Upon receiving the print command PC for the (n+1)th printing operation, the controller 51 sends a count halt signal CH to the timer 54.

Step S6: The timer 54 send its count τ to the controller 51.

Step S7: The controller checks the value of τ to the determine whether the τ is greater than the time length T12−T11. The program proceeds to step S8 if τ>(T12−T11), and to step S9 if τ≦(T12−T11).

Step S8: The controller 51 sets the bias voltage $V_B$ of to $+V_1$ to begin the (n+1)th printing operation.

Step S9: The controller 51 sets the bias voltage $V_B$ to $-V_2$ to begin the (n+1)th printing operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic printer, comprising:

a rotating image bearing body;

a charging device that charges a surface of said image bearing body;

an image writing device disposed beyond said charging device in a direction of rotation of said image bearing body, said image writing device having at least one light-emitting element which emits light to illuminate the surface of said image bearing body so as to form an electrostatic latent image on the surface during a first duration;

a developing device disposed beyond said image writing device in the direction of rotation of said image bearing body, said developing device depositing a developer material on the electrostatic latent image to convert the electrostatic latent image into a visible image; and a controller, controlling said image writing device to emit the light, said controller driving said image writing device to emit the light in accordance with print data only during the first duration, wherein said controller does not drive said image writing device in accordance with print data at any time other than during the first duration, and said controller driving said image writing device to emit light continuously for a second duration not overlapping the first duration, to decrease a potential of the surface of said image bearing body.

2. The electrophotographic printer according to claim 1, wherein said second duration includes a first predetermined time period immediately after the first duration of a preceding one of consecutive printing operations and a second predetermined time period immediately before the first duration of a following one of the consecutive printing operations.

3. The electrophotographic printer according to claim 2, wherein said image bearing body stops rotating after said first predetermined time period and said image bearing body starts rotating immediately before said second predetermined time period.

4. The electrophotographic printer according to claim 2, wherein the first predetermined time period is a length of time during which the surface of said image bearing body rotates from said image writing device to said developing device.

5. The electrophotographic printer according to claim 2, wherein the second predetermined time period is a length of time during which the surface of said image bearing body rotates from said charging device to said image writing device.

6. The electrophotographic printer according to claim 2, wherein said image writing device includes a plurality of light emitting elements, and said controller drives all of the plurality of light emitting elements to simultaneously emit light during the first and second durations.

7. The electrophotographic printer according to claim 6, wherein the second duration is a length of time following the first duration.

8. The electrophotographic printer according to claim 6, wherein the second duration is a length of time preceding the first duration.

9. The electrophotographic printer according to claim 1, wherein said image writing device includes a plurality of light emitting elements and said controller drives all of the plurality of light emitting elements to simultaneously emit light during the second duration.

10. An electrophotographic printer, comprising:

an image bearing body;

a charging device that charges a surface of said image bearing body;

an image writing device having at least one light-emitting element that emits light to illuminate the surface of said image bearing body;

a developing device that deposits a developer material on the electrostatic latent image to convert the electrostatic latent image into a visible image; and a controller that controls said image writing device to emit light in accordance with print data for a first duration, illuminating the surface of said image bearing body to form an electrostatic latent image on the surface;

wherein said controller determines an elapsed time measured from an end of a first duration of a preceding one of consecutive printing operations until a beginning of a first duration of a following one of the consecutive printing operations, and said controller causes said developing device to receive a bias voltage for the following one of the consecutive printing operations, the bias voltage being of a same polarity as the surface of said image bearing body charged by said charging device if the elapsed time is shorter than a predetermined threshold.

11. The electrophotographic printer according to claim 10, wherein said developing device receives the bias voltage for a length of time during which the surface of said image bearing body rotates from said image writing device to said developing device.

* * * * *